US009353573B2

(12) United States Patent
Ebersole et al.

(10) Patent No.: US 9,353,573 B2
(45) Date of Patent: May 31, 2016

(54) DRILLING UNIT OPERATOR STATION

(71) Applicant: American Augers, Inc., West Salem, OH (US)

(72) Inventors: Paul D. Ebersole, Perry, OK (US); Forrest D. Walker, Edmond, OK (US)

(73) Assignee: American Augers, Inc., West Salem, OH (US)

( * ) Notice: Subject to any disclaimer, the term of this patent is extended or adjusted under 35 U.S.C. 154(b) by 274 days.

(21) Appl. No.: 14/076,601

(22) Filed: Nov. 11, 2013

(65) Prior Publication Data

US 2014/0131113 A1 May 15, 2014

Related U.S. Application Data

(60) Provisional application No. 61/724,472, filed on Nov. 9, 2012.

(51) Int. Cl.
*E21B 7/02* (2006.01)
*E21B 7/04* (2006.01)

(52) U.S. Cl.
CPC ..... *E21B 7/046* (2013.01); *E21B 7/022* (2013.01)

(58) Field of Classification Search
CPC ..... E21B 7/046; E21B 7/02; E21B 15/04; E21B 41/0021
USPC ..... 175/219
See application file for complete search history.

(56) References Cited

U.S. PATENT DOCUMENTS 4,090,736 A * 5/1978 Finney ..... E21C 27/24 175/219
4,486,137 A 12/1984 Buckner
4,765,401 A 8/1988 Boyadjieff
2011/0048733 A1 3/2011 Hudson et al.

FOREIGN PATENT DOCUMENTS

CN 201283912 Y 8/2009
EP 0199664 B1 10/1993

* cited by examiner

*Primary Examiner* — Catherine Loikith
(74) *Attorney, Agent, or Firm* — Tomlinson Rust McKinstry Grable

(57) ABSTRACT

A horizontal directional drilling system with a removable operator station having a frame, a carriage, a base, and a removable cab. The carriage is moveable relative to the frame to provide thrust and rotation to a drill string. The base is located on the frame and has an attachment point and a fitting. The removable cab has a control system for controlling functions of the carriage and the frame and a bracket moveable between a first position and a second position. The bracket is connectable to the attachment point. The cab is moveable relative to the base when the bracket is disconnected from the attachment.

20 Claims, 5 Drawing Sheets

DRILLING UNIT OPERATOR STATION

CROSS REFERENCE TO RELATED APPLICATION

This application claims the benefit of provisional patent application Ser. No. 61/724,472 filed on Nov. 9, 2012, the entire contents of which are incorporated herein by reference.

FIELD OF THE INVENTION

The present invention relates generally to the field of directional drills and in particular for systems for controlling operation of directional drills.

SUMMARY OF THE INVENTION

The present invention is directed to a horizontal directional drilling ("HDD") system with a removable operator station. The system comprising a frame, a carriage, a base, and a removable cab. The carriage is moveable relative to the frame to provide thrust and rotation to a drill string. The base is located on the frame and comprises an attachment point and a fitting. The removable cab comprises a control system, a bracket and a foot. The control system controls functions of the carriage and of the frame. The bracket is moveable between a first position and a second position, and is connectable to the attachment point in the first position. The cab is stable on the base when the foot is located in the fitting and the cab is moveable relative to the base when the bracket is disconnected from the attachment.

The present invention is also directed to a HDD machine comprising a frame, a carriage, a fastener and a cab. The carriage is moveable relative to the frame to provide thrust and rotation to a drill string. The cab is attachable to and removable from the frame comprising an operator station. The operator station controls the thrust and rotation of the carriage. The fastener is movable between a first position and a second position. The fastener connects the cab to the frame when in the first position.

The present invention is also directed to a method for controlling a HDD machine. The drill comprising a frame, a carriage, and a removable cab. The carriage is moveable relative to the frame to provide thrust and rotation to a drill string. The cab comprises a control panel. The method comprises moving a fastener from a first position to a second position, detaching the cab from the frame and controlling the carriage from the control panel and advancing the drill string.

DESCRIPTION OF THE PREFERRED EMBODIMENT

HDD machines are used to install underground utilities or other objects. HDD technology has become popular because it is a versatile way to install underground pipelines in a variety of subsurface terrains while minimizing ground surface disruption and the likelihood of damaging already-buried objects.

HDD operations generally consist of using the drilling machine to advance a drill string through the subterranean earth along a path. The path may be preselected to avoid already-buried objects such as utilities.

The drilling machine generally comprises a frame, an anchoring system, a drive assembly mounted to the frame and connectable to the uphole end of the drill string, and a bit connected to the downhole end of the drill string. The drive assembly provides thrust and rotation to the drill string which, in turn, thrusts and rotates the bit through the subterranean earth, forming a borehole. The drive assembly generally comprises one or more power sources for thrusting and rotating the drill string. The drill string is advanced in a substantially straight line direction by a simultaneous rotating and thrusting of the drill string by the drive assembly. To change the direction, conventional steering techniques are used such as those associated with a slant-faced bit or downhole tool having a deflection structure. When the borehole is completed, typically the bit is replaced with a backreaming tool. Then the drive assembly is used to provide pullback force together with rotation to the drill string which, in turn, will pullback and rotate the backreamer back through the borehole to pack and finally size the borehole. The product to be installed may be connected to the trailing end of backreaming tool and pulled into the borehole behind the backreamer.

The operator of the HDD machine is typically positioned either on the drilling machine itself at an operator station or in the case of larger HDD machines at an operator station remote from the drilling machine. The present invention provides an operator station that may be placed on the drilling machine or removed from the drilling machine and placed at a location remote from the machine.

Figure 1:
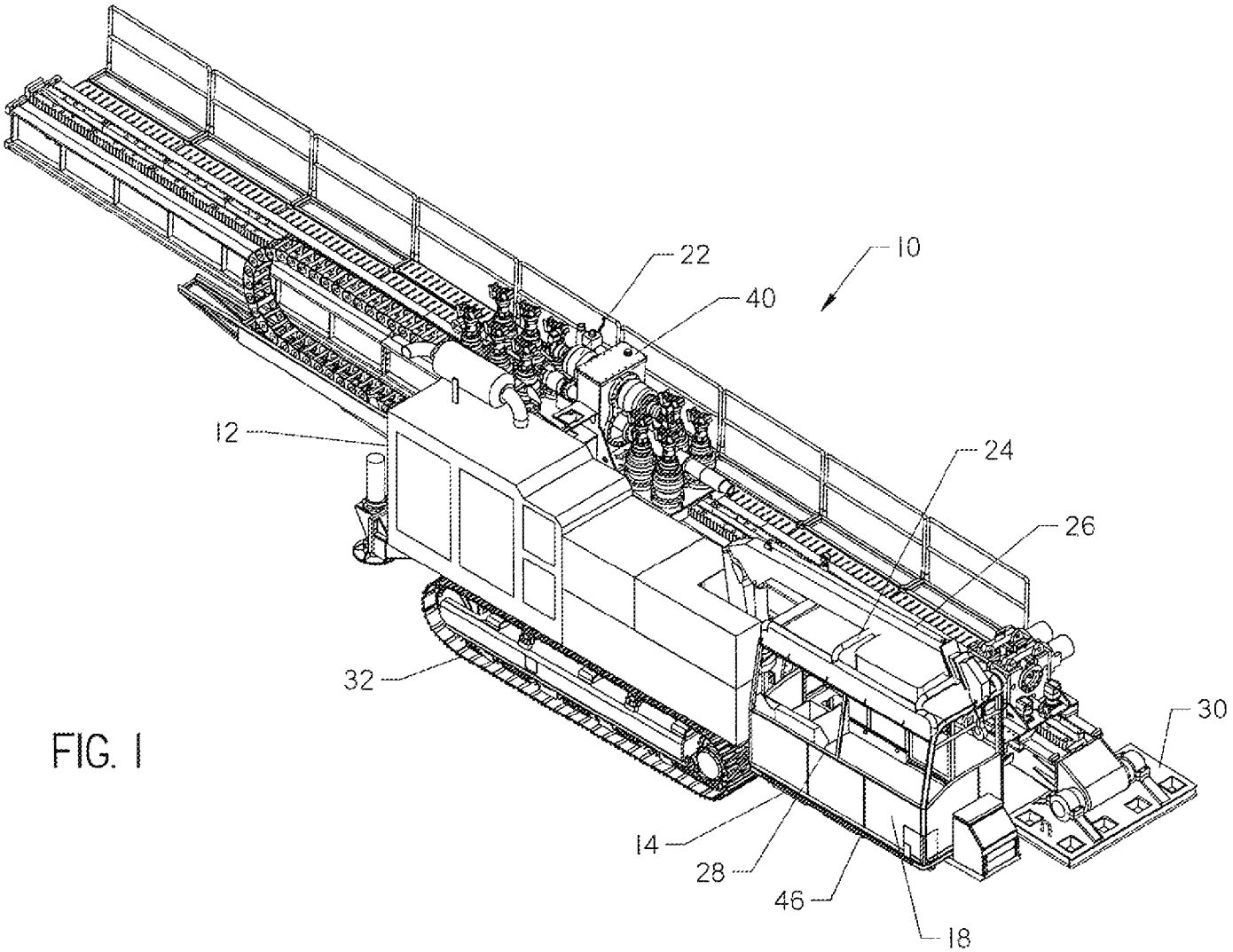
FIG. 1 is a diagrammatic representation of a HDD system constructed in accordance with the present invention.

Turning now to the drawings in general and to FIG. 1 in particular, shown therein is a horizontal drilling system 10 in accordance with the present invention. The drilling system 10 preferably comprises a drilling machine 12 having a frame 14. The system further comprises a drill string 16 (FIG. 2) and a removable cab 18. The system may optionally have a pipe-handling device 20 (FIG. 2) supported on the frame to hold a plurality of pipe sections 21. The drill string 16 is coupled to a drive system 22 at an uphole end of the drill string. The drive system 22 comprises a carriage 40 that is moveable relative to the frame 14 to provide thrust and rotation to the drill string 16. The drill string 16 has an underground tool (not shown) attached to it at a downhole end. The underground tool may comprise a housing for supporting a beacon used to track the location of the tool.

The removable cab 18 is moveable relative to the drilling machine 12 in a manner to be described herein. The cab 18 comprises a control system for controlling functions of the drive system 22 and the frame 14. The control system may comprise a control panel for controlling operation of the drilling system 10. Such controls may include pressure gauges, joysticks, toggle switches analog and digital displays, and levers used to control different and various functions of the machine during a drilling operation. The cab 18 may have connection points 24 on the top of the cab for connecting a crane 26 to the cab to lift and remove the cab from the frame 14. Additionally, the cab 18 may comprise a forklift connection point (not shown). The cab may comprise a window 28 disposed to allow an operator to view the drilling machine 12 during operation. The cab shown in FIG. 1 is fully enclosed and may comprise the window 28 and a door (not shown) to protect the operator from bad weather. However, one skilled in the art will appreciate that the removable cab of the present invention may be open without departing from the spirit of the present invention.

The drilling machine 12 may further include an anchor system 30 to secure the machine 12 to the ground during drilling operations. The machine may also comprise a tracked drive system 32 used to move the machine from one location to another.

Figure 2:
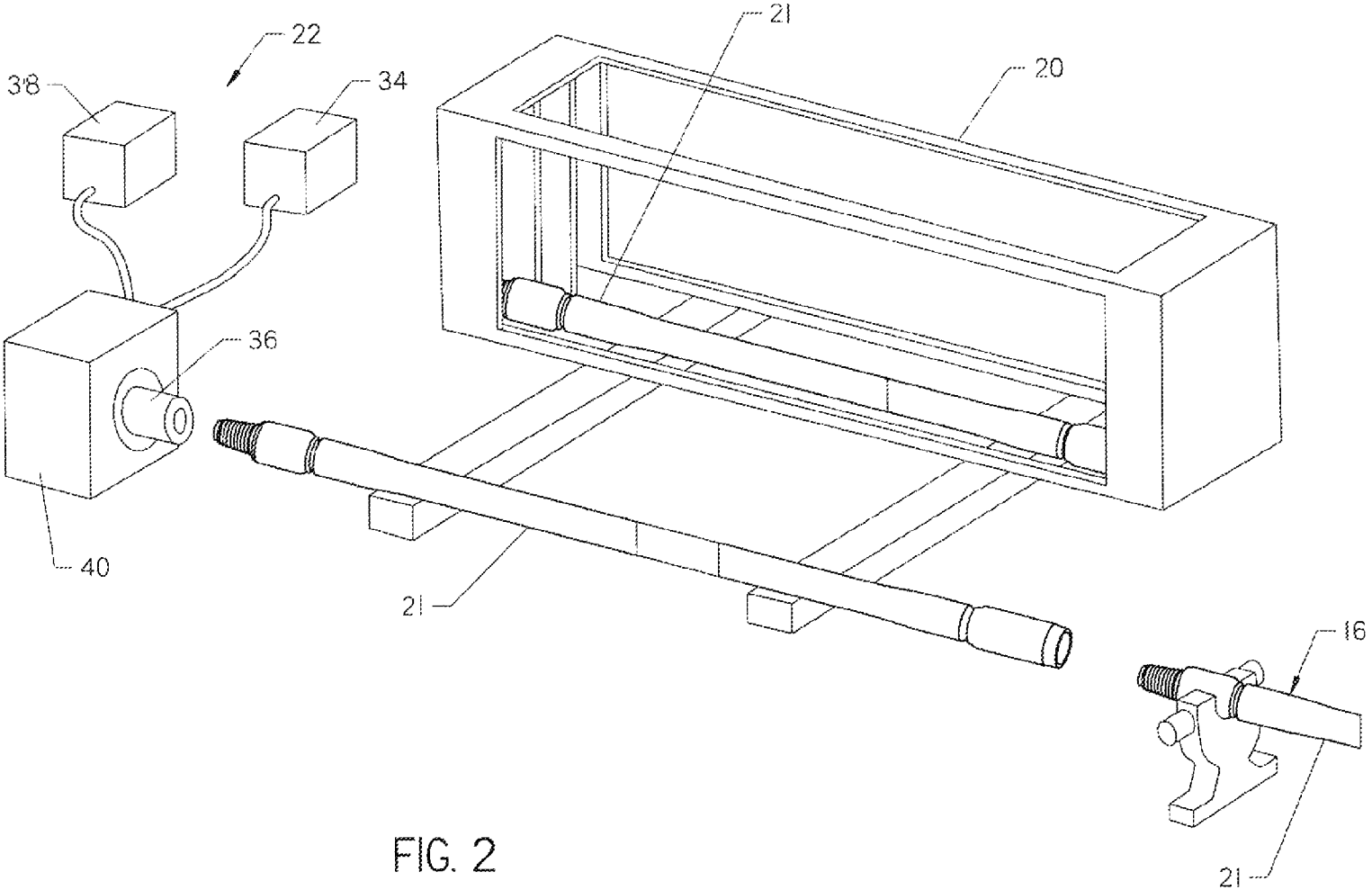
FIG. 2 is a diagrammatic representation of the drive system of the drilling machine of FIG. 1.

With reference to FIG. 2, there is shown therein the components of the drive system 22. The drive system 22 generates and provides the power applied to the drill string 16 by the drilling machine 12. As will be explained more fully below, the drive system 22 comprises an engine and a plurality of hydraulic pumps or motors, valves, and plumbing that supply power to the various components of the drilling machine 12. However, the invention contemplates the use of any system suitable for powering the components of the drilling machine 12. For example, electric or combustion powered equipment may be used for the engine and the plurality of sources supplying power to the components of the drilling machine 12. In an alternative embodiment, power sources such as fuel cells can be used to generate power locally for any of the various components of the drilling machine 12.

With continued reference to FIG. 2, the drive system 22 in this embodiment may comprise separate hydraulic motors for rotating and axially moving the drill string 16. As with other components of the drilling machine 12, an engine and hydraulic pumps (not shown) supply power needed to operate the hydraulic motors for powering rotation and axial movement through control valves. As used herein, the hydraulic motors together with the power source to operate the motors shall be collectively known as power units.

A rotation power unit 34 is operatively connected to a rotatable spindle 36 to drive rotation of the spindle. A thrust power unit 38 is operatively connected to a movable carriage 40 that can be advanced or retracted. It may be noted that thrust refers to a linear force caused by the drive system 22 and could be either a forward or reverse linear force as follows. During drilling operations, the drill string 16 is pushed or thrust forward through the earth. During the backreaming process, the drill string 16 is retracted or pulled back through the borehole. Whether thrusting or pulling back, axial movement of the carriage 40 will in turn cause the spindle 36 and the drill string 16 to be similarly thrust forward or pulled back, respectively. As used herein, axial movement will be understood to include advancing or thrusting, and retracting or pulling back.

The spindle 36 is mounted in carriage 40 and usually comprises an internally threaded spindle pipe joint for connection to an externally threaded end of a pipe section 21. The opposite end of the pipe section 21 then connects with an externally threaded end of another pipe section. Therefore, in the preferred embodiment a plurality of individual pipe sections 21 are connected together at the threaded pipe joints to form the drill string 16. However, the invention would be equally applicable to a drilling machine 12 using other kinds of drill strings, such as a drill string made up of pipe sections secured together in a manner other than with threaded pipe joints or a drill string comprising coil tubing.

The spindle 36 is rotatable about its central longitudinal axis. The operations of making up and breaking out the connections between the spindle 36 and the end of the drill string 16, between the spindle and an individual pipe section 21, or between the pipe sections comprising the drill string, involve coordination between the rotation and thrust of the spindle. Whenever a connection is made ("makeup") or broken ("breakout"), the rotation and axial movement of the spindle 36 about its axis is coordinated to generally meet the threaded pitch of the pipe sections 21 so that the threads of the pipe joints are not damaged.

In this manner, the thrust power unit 38 and the rotation power unit 34 can be selectively activated to impart rotation and thrust output to the drill string 16. However, other power units may be employed to control various other kinematic components of drill string 16 motion such as pull back at constant or varying rates of motion. Additionally, each kinematic component of drill string 16 motion may be selectively activated independently or in combination with other components. For example, thrust only can be activated, or thrust and rotation together, or rotation only.

With continued reference to FIG. 2, the pipe handling device 20 is used to extend the length of the drill string 16 as the drill string is advanced through the earth. The pipe-handling device 20 adds and removes threaded pipe sections 21 to and from the drill string 16 in makeup and breakout operations. Suitable pipe handling devices are described in U.S. Pat. No. 6,179,065, issued Jan. 30, 2001, entitled System and Method for Automatically Controlling a Pipe Handling System for a Horizontal Boring Machine, and U.S. Pat. No 6,085,852, issued Jul. 11, 2001, entitled Pipe Handling Device. The contents of both patents are incorporated herein by reference.

While the present embodiment has been discussed with reference to a single pipe drill string, one skilled in the art will appreciate that the drilling system of the present invention may use dual-pipe drill string and pipe handling system as disclosed in U.S. Pat. No. 7,987,924, issued Aug. 2, 2011, entitled Automatic Control System for Connecting a Dual-Member Pipe, and U.S. Pat. No. RE38,418 issued Feb. 10, 2004, entitled Dual-Member Pipe Joint for a Dual Member Drill String. The contents of both patents are incorporated herein by reference.

Each of the functions of the HDD system described with reference to FIGS. 1 and 2 may be controlled from the cab 18 using the previously described controls.

Figure 3:
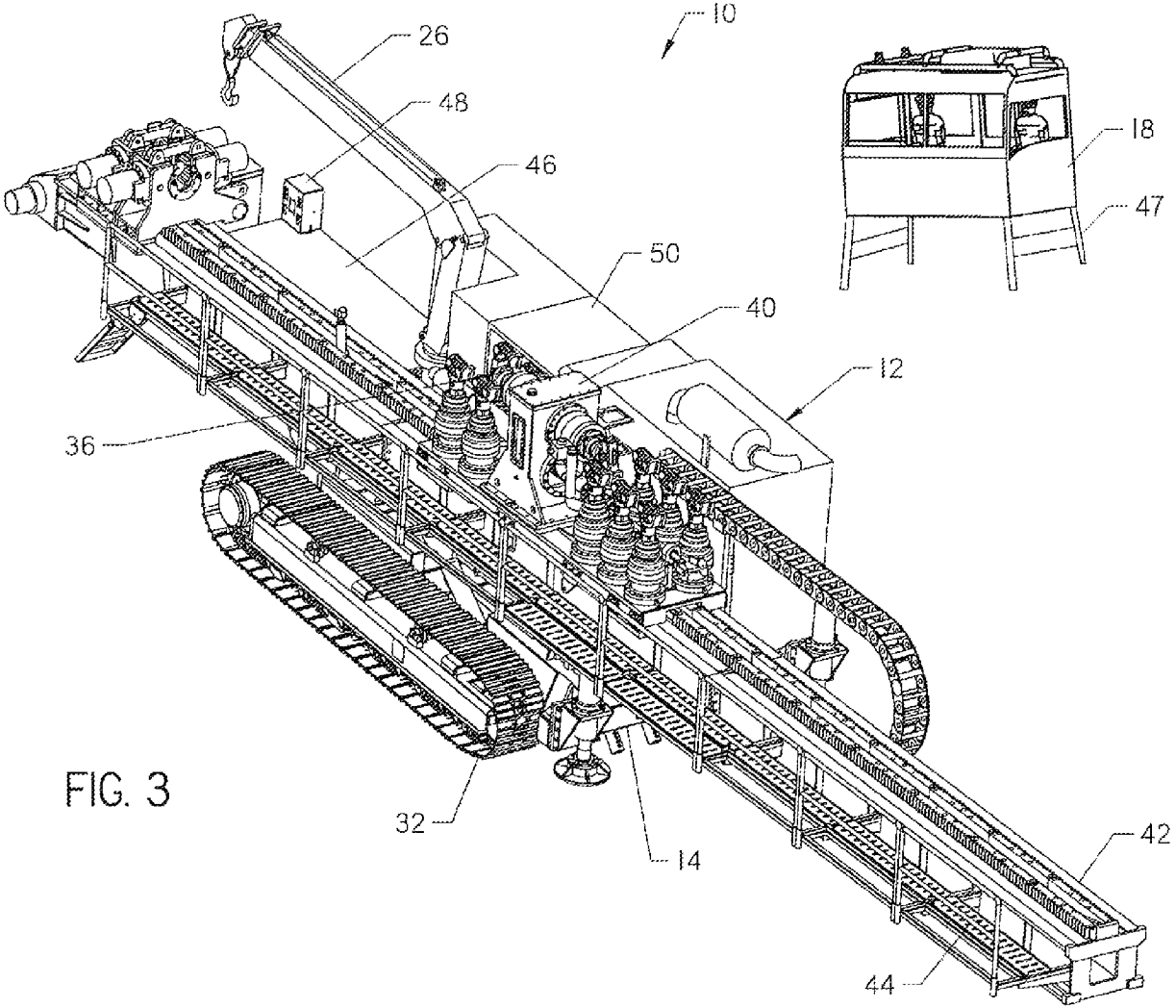
FIG. 3 is a view of the HDD system of FIG. 1 having the operator cab removed therefrom.

Turning now to FIG. 3, there is shown therein a reverse view of the HDD system 10 shown in FIG. 1. The view of FIG. 3 provides a clear view of the carriage 40 positioned on the frame 14. The carriage 40 shown is moveable along a track 42 positioned on the frame. The machine 12 may further comprise a catwalk 44 disposed alongside the track 42. The catwalk 44 provides an operator access to drill pipe positioned along the track and connected to the spindle. In certain embodiments, usually smaller sized drilling machines, the catwalk 44 may be replaced with the pipe handling system 20 previously discussed.

Continuing with FIG. 3, the operator cab 18 has been removed from a base 46. The cab 18 may be supported on a set of legs or jacks 47 or may rest on a cradle 68 (FIG. 5) when removed from the base 46. The set of legs or jacks 47 may be removable from the cab 18 or may fold up under the cab 18 when not in use. The legs or jacks 47 may also be used to raise the cab 18 vertically while remaining supported on the base 46 and still wired to the drilling machine 12. Raising the cab 18 up and away from the drilling machine 12 cuts down on the amount of vibrations and noise within the cab 18 during drilling operations.

The base 46 is located on the frame 14 and comprises a yet to be described attachment point and a fitting. As shown, a communication panel 48 positioned on the base 46. The communication panel 48 provides a remote cab connection point. The communication panel 48 may comprise a wired or wireless connection point between the cab 18 and the drilling machine 12 when the cab is not positioned on the base 46.

Such communication link between the operator cab 18 and the machine may be made by commonly known communication links such as Wi-Fi, radio, Bluetooth, coaxial cable, fiber optics, twisted pair wiring, etc. The communication panel 48 may be easily removed from the base 46 and stored for later use when the cab is positioned on the base 46. Communication panel 48 may also comprise machine controls to allow the operator to move the machine 12 to a different location or change the angle of the frame while the cab is removed from the machine. This gives the operator the ability to transport and setup the drilling machine 12 while the cab 18 is disconnected.

Crane 26 is shown supported on the machine 12 near the engine compartment 50 in the embodiment of FIG. 3. One skilled in the art will appreciate that having the crane 26 supported on the machine 12 may not be practical in smaller embodiments of the machine 12. Accordingly, the cab 18 may comprise forklift points so the operator can remove the cab without the need for the crane. Of course, the crane 26 may simply comprise a crane separate from the machine. Alternatively, an operator could use a backhoe to remove the cab 18 from the base.

Figure 4:
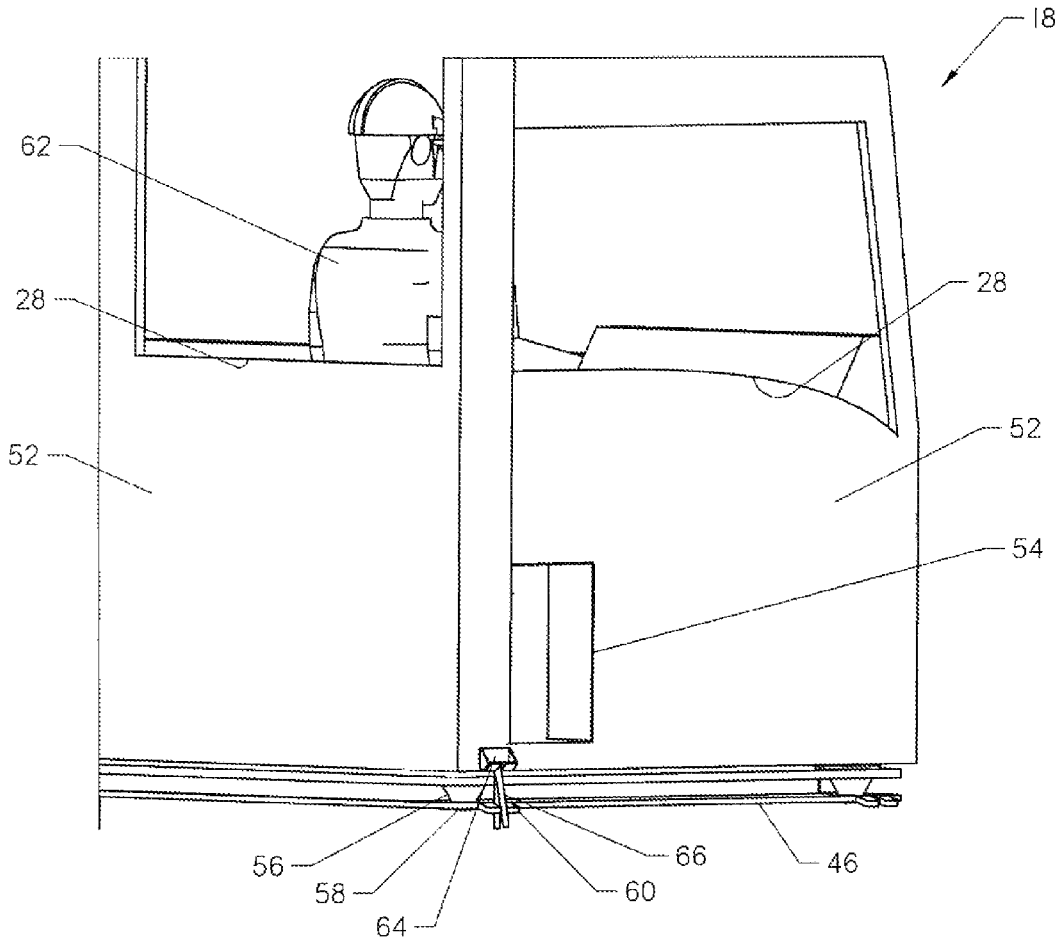
FIG. 4 is a partial view of an operator's cab positioned on a frame of the HDD machine.

Turning now to FIG. 4, there is shown therein a partial view of a corner of the removable cab 18 disposed on the base 46. As previously described, the removable cab may comprise an enclosed cab having sidewalls 52 and windows 28. The sidewall 52 may comprise a compartment 54 configured to support the communication panel 48 described with reference to FIG. 3. Disposed on the underside of the cab 18 is a foot 56 configured to fit within the fitting 58 formed on the base 46, As shown in FIG. 4, the foot 56 may comprises a frustoconical projection from the underside of the cab 18. This shape assists the operator in guiding the foot 56 into the fitting 58 when placing the cab on the base 46. The cab may comprise a plurality of feet 56 positioned at the corners of the cab. Likewise, the base 46 may comprise a corresponding number of fittings 58. Having the foot 56 positioned in the fitting 58 stabilizes the cab 18 on the base 46.

The base 46 further comprises an attachment point 60 disposed on a side of the base to provide the operator 62 easy access. The attachment point 60 corresponds to a fastener comprising a bracket 64 disposed on the cab 18. A linking member 66 comprising a T-bar and wing nut or locking nut may be used to secure the bracket 64 to the attachment point 60 when the bracket is in a first position. The bracket is connectable to the attachment point 60 in the first position. In operation the cab 18 is positioned over the base 46 so that feet 56 align with fittings 58. The cab is lowered onto the base and the feet guide the cab into the proper position. The T-bar end of the linking member 66 is positioned in the bracket 64 and the opposing end having the wing nut is pivoted into a slot formed in the attachment point 60. The wing nut may then be turned clockwise to tighten the connection between the base 46 and the cab 18 to secure the cab to the machine 12.

Figure 5:
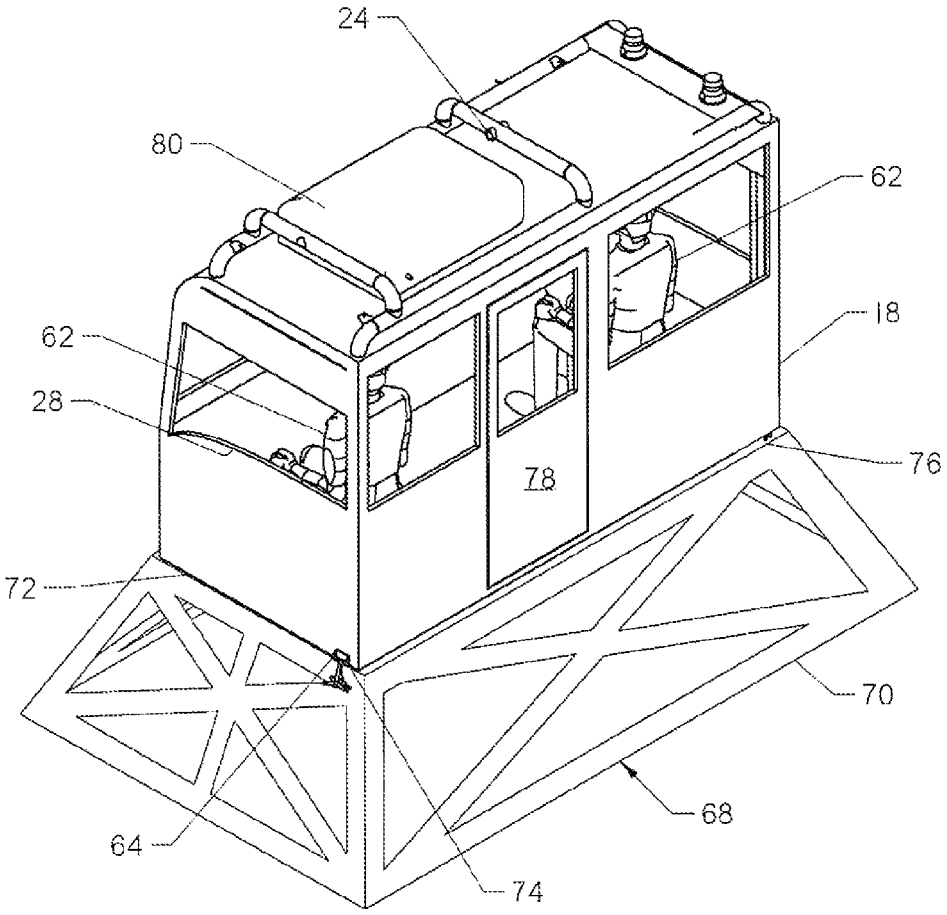
FIG. 5 shows the cab removed from the HDD machine and positioned on a cradle.

Turning now to FIG. 5, the cab 18 is shown in greater detail and positioned on the cradle 68. The cradle 68 is remote from the drilling machine 12 and comprises a ground engaging portion 70 and a cab-engaging portion 72. The ground engaging portion 70 may comprise adjustable legs that may bound an area greater than the area of the cab engaging portion 72.

The cab-engaging portion 72 comprises a cradle attachment point 74 and a cradle fitting (not shown) similar to the fitting shown in FIG. 4. The cradle fitting will comprise a hole formed in the cradle base 76 located on the base to correspond to the feet 56 (FIG. 4). The cradle attachment point 74 and the bracket 64 are used to secure the cab 18 to the cradle 68 in the same way the cab is connected to the base 46 of the drilling machine 12. Accordingly, the cradle attachment point 74 may comprise a slot formed to allow the linking member 66 to be positioned within the attachment point when the bracket is in the first position.

As previously discussed, the cab 18 may comprise a plurality of windows 28 to allow the operators a view of the machine 12 and the surrounding job site. The cab 18 may also comprise a door 78. The cab may be outfitted with attachment points 24 for the crane 26 and may also include a climate control system 80. Inside the cab 18 is an operator station used to control the drilling machine 12. From the operator's station the operator may control the thrust and rotation of the carriage 40 as well as makeup and breakout of drill pipe sections 21 from the drill string 16.

In operation, the cab 18 may be detached from the frame 14 of the drilling machine 12 and placed at a location remote from the machine. The cab is linked to the machine either by a wired connection or wirelessly to allow the operator to control the carriage 40 from a control panel (not shown) disposed in the cab. Control of the carriage 40 allows the operator to advance and retract the drill string 16 and thus any downhole tooling or product attached to the downhole end of the drill string.

The cab 18 may be removed from the machine 12 and placed on a cradle and secured to the cradle by moving a bracket from a second position (open position) to a first position (closed position) to connect the cradle and the cab. The cradle provides a stable base for the cab 18 when removed from the machine 12 and also elevates the operator relative to the job site to provide improved visibility.

One of skill in the art will appreciate that there are multiple other ways of utilizing the ability to remotely control the drilling system 12. For example, the operator 62 may control the drilling machine 12 from the cab 18 attached to the frame 14 while a second operator has the ability to simultaneously control the drilling machine from a second cab detached from the frame. An office located at a remote location from the drilling machine 12 may also be fitted with the ability to communicate with the communication panel 48 (FIG. 3) in order to control operations of the drilling machine.

Although the present invention has been described with respect to preferred embodiment, various changes and modifications may be suggested to one skilled in the art, and it is intended that the present invention encompass such changes and modifications as fall within the scope of this disclosure.

What is claimed is:

1. A horizontal directional drilling system with a removable operator station comprising:

a frame;

a carriage moveable relative to the frame to provide thrust and rotation to a drill string;

a base located on the frame comprising an attachment point and a fitting;

a removable cab comprising:

a control system for controlling functions of the carriage and of the frame;

a bracket moveable between a first position and a second position, wherein the bracket is connectable to the attachment point in the first position; and a foot;

wherein the cab is stable on the base when the foot is located in the fitting; and wherein the cab is moveable relative to the base when the bracket is disconnected from the attachment point.

2. The horizontal directional drilling system of claim 1 wherein the cab further comprises a control panel for controlling operation of a drilling unit.

3. The horizontal directional drilling system of claim 2 wherein the control panel is connected to the drilling unit with wires at a remote cab enclosure connection.

4. The horizontal directional drilling system of claim 2 wherein the control panel wirelessly communicates with the drilling unit.

5. The horizontal directional drilling system of claim 1 wherein the cab further comprises a forklift connection point.

6. The horizontal directional drilling system of claim 1 wherein the cab further comprises a crane connection point.

7. The horizontal directional drilling system of claim 1 further comprising a cradle remote from the drilling unit, wherein the cradle comprises ground engaging portion and a cab engaging portion, the cab engaging portion comprising:

a cradle attachment point; and a cradle fitting;

wherein the cradle attachment point is connectable to the bracket when the bracket is in the first position and wherein the cab is stable on the cradle when the foot is located in the cradle fitting.

8. The horizontal directional drilling system of claim 7 wherein the cradle comprises adjustable legs.

9. The horizontal directional drilling system of claim 7 wherein the ground engaging portion has an area greater than an area of the cab engaging portion.

10. The horizontal directional drilling system of claim 1 wherein the foot is frustoconical.

11. The horizontal directional drilling system of claim 1 wherein the bracket is pivotally connected to the cab.

12. The horizontal directional drilling system of claim 11 wherein the attachment point comprises a slot such that the bracket may be disposed through the slot when in the first position.

13. The horizontal directional drilling system of claim 12 wherein the bracket comprises a locking nut for securing the bracket to the attachment point when the bracket is in the first position.

14. The horizontal directional drilling system of claim 11 further comprising a cradle remote from the drilling unit, wherein the cradle comprises ground engaging portion and a cab engaging portion, the cab engaging portion comprising:

a cradle attachment point; and a cradle fitting;

wherein the cradle attachment point is connectable to the bracket when the bracket is in the first position and wherein the cab is stable on the cradle when the foot is located in the cradle fitting.

15. The horizontal directional drilling system of claim 14 wherein the cradle attachment point comprises a cradle attachment point slot such that the bracket may be disposed through the slot when the bracket is in the first position.

16. A horizontal directional drill comprising:

a frame;

a carriage moveable relative to the frame to provide thrust and rotation to a drill string; and a cab attachable to and removable from the frame comprising an operator station, wherein the operator station controls the thrust and rotation of the carriage;

a fastener movable between a first position and a second position, wherein fastener connects the cab to the frame when in the first position.

17. The horizontal directional drill of claim 16 wherein the fastener comprises a bracket moveable between the first position and the second position.

18. A method for controlling a horizontal directional drill, the horizontal directional drill comprising a frame, a carriage movable relative to the frame to provide thrust and rotation to a drill string, and a removable cab comprising a control panel, the method comprising:

moving a fastener from a first position to a second position;

detaching the cab from the frame;

controlling the carriage from the control panel; and advancing the drill string.

19. The method of claim 18 further comprising positioning the cab on the frame after advancing the drill string and moving the fastener from the second position to the first position to attach the cab to the frame.

20. The method of claim 18 further comprising:

providing a cradle;

placing the cab on the cradle; and moving the fastener from the second position to the first position to connect the cab to the cradle.

* * * * *